US007650893B2

(12) United States Patent
De Laforcade

(10) Patent No.: US 7,650,893 B2
(45) Date of Patent: Jan. 26, 2010

(54) DEVICE FOR APPLYING A HAIR PRODUCT

(75) Inventor: Vincent De Laforcade, Rambouillet (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 11/247,375

(22) Filed: Oct. 12, 2005

(65) Prior Publication Data

US 2006/0076030 A1 Apr. 13, 2006

Related U.S. Application Data

(60) Provisional application No. 60/620,690, filed on Oct. 22, 2004.

(30) Foreign Application Priority Data

Oct. 12, 2004 (FR) ..... 04 52341

(51) Int. Cl.
*A45D 40/26* (2006.01)
*A45D 24/00* (2006.01)

(52) U.S. Cl. ..... 132/218; 132/219; 132/161

(58) Field of Classification Search ..... 132/112–116, 132/126, 139, 141, 142, 161, 120, 218, 219; 401/28, 282, 270, 278, 287
See application file for complete search history.

(56) References Cited

U.S. PATENT DOCUMENTS 3,128,487 A * 4/1964 Vallis ..... 15/176.1
3,133,546 A * 5/1964 Dent ..... 132/120
5,307,825 A * 5/1994 Smith ..... 132/200
5,758,984 A 6/1998 Doherty
5,979,463 A * 11/1999 Santy et al. ..... 132/120
6,145,513 A 11/2000 Chu et al.
6,308,717 B1 * 10/2001 Vrtaric ..... 132/200
6,341,611 B1 * 1/2002 Nakamura ..... 132/120
7,000,618 B2 * 2/2006 Dovergne et al. ..... 132/116
2003/0041869 A1 3/2003 Dovergne et al.

FOREIGN PATENT DOCUMENTS

FR 0 890 326 A2 1/1999
FR 2 782 614 3/2000
FR 2 828 999 3/2003
JP 4-56022 5/1992
JP 8-8655 3/1996

* cited by examiner

*Primary Examiner*—Robyn Doan
(74) *Attorney, Agent, or Firm*—Oblon, Spivak, McClelland, Maier & Neustadt, L.L.P.

(57) ABSTRACT

A device for applying a hair product which includes a support on one face of which there projects application elements. The application elements are arranged such that a first group of application elements of a first row is superposable, along a longitudinal axis (X) of the support, with a second group of application elements of a second row. The application elements of the second group have a mean flexibility and/or a mean height that is greater respectively than the mean flexibility and/or the mean height of the application elements of the first group. In addition, the mean of the spacings between application elements that make up the second group is less than the mean of the spacings between application elements that make up the first group.

51 Claims, 4 Drawing Sheets

DEVICE FOR APPLYING A HAIR PRODUCT

CROSS-REFERENCE TO RELATED APPLICATIONS

This document claims priority to French Application Number 04 52341, filed Oct. 12, 2004, and U.S. Provisional Application No. 60/620,690, filed Oct. 22, 2004, the entire contents of which are hereby incorporated by reference.

BACKGROUND OF THE INVENTION

1. Field of the Invention

The present invention relates to a device for applying a product to the hair. The invention can be particularly advantageous for applying a hair coloring product.

2. Discussion of the Background

Devices are known which include a container and an application part provided with teeth, at the base of which open orifices for dispensing the product contained in the container onto the head of hair. In particular, FR-A-2 782 614 discloses an example of a device for applying a product which includes a container and a dispensing head equipped with two peripheral rows of end teeth, having, between these, an intermediate row of shorter teeth.

FR-A-2 828 999 discloses a similar device for which the end teeth are arranged in such a way as to be positioned in a closed curve surrounding the intermediate row of shorter teeth. In these examples, the spacing between the teeth in the intermediate row is the same as the spacing between the end teeth.

U.S. Pat. No. 5,758,984 also discloses a device for packing and applying a cosmetic product, which includes an applicator head covered with bristles in the middle of which there are teeth via which a product contained in the device is dispensed. This device presents a problem because the product dispensed is not held at the periphery of the applicator head and runs the risk of running in undesired directions at the time of application.

EP-A-0 890 326 describes a brush used to color hair using a coloring product, with projecting elements of the brush being impregnated with the product or able to diffuse it.

As a further example, U.S. Pat. No. 6,145,513, discloses a dispensing head intended to apply a coloring product to the hair, and designed to be mounted on a container containing the coloring product that is to be applied. The dispensing head includes a support equipped with a flat face from which teeth of various cross sections and various heights protrude. A first row of consecutive and identical teeth are arranged along a longitudinal peripheral edge of the support. In addition, the support includes a second row of consecutive and identical teeth, with the teeth of the second row having a cross section and height smaller than those of the teeth of the first row. Nonetheless, the respective spacings between the teeth of the first and second rows are identical.

U.S. Pat. No. 6,145,513 also includes an arrangement of fine and very closely spaced teeth provided at one longitudinal end of the support. This arrangement is set out perpendicular to the longitudinal peripheral edges of the support and is therefore oriented at right angles to the first and second rows. These fine teeth are designed to allow a finer application of the coloring product, for example when it needs to be applied to often fine and very short locks of hair around the temples.

The user, when wishing to treat some arbitrary lock of hair using such an applicator head, moves the applicator head in a movement perpendicular to one of the longitudinal peripheral edges, so as to allow the lock of hair to engage between the teeth of the first and second rows. This lock of hair must not be inserted among the fine teeth, because that could hamper brushing and the correct and uniform coating of this lock of hair with the product.

By contrast, when the user wishes to apply the product near her temples, she has to turn the applicator head through 90° so as to be able to engage the lock of hair around her temples in just the rows of fine teeth.

Such an applicator head is designed to use the rows of teeth parallel to the longitudinal peripheral edges independently of the arrangement of fine teeth.

The problem generally encountered when applying a hair coloring product can stem from the very nature of the product that is to be applied. Specifically, this product generally results from the mixing of a liquid product with a powder. This mixture generally contains lumps of powder which have not mixed with the remainder of the liquid. Such lumps may also form when two highly viscous liquids are mixed, with the lumps including the more viscous liquid. In any event, it is difficult to get rid of these lumps using the implements generally available in a bathroom or hairdressing salon.

The use of an applicator head as taught by document U.S. Pat. No. 6,145,513 can lead to such lumps being deposited on the locks of hair when the user uses the first and second rows of teeth parallel to the longitudinal peripheral edges. Since the fine-teeth arrangement cannot hold enough product to treat an entire lock of hair, this arrangement does not perform well in coating long and thick locks of hair.

In addition, as such lumps are deposited on the head of hair, they can locally detract from the treatment of the hair which is then locally colored to a lesser extent, if at all. Furthermore, there is a risk that the lumps will fall off the lock of hair under gravity and then contaminate another lock of hair that was not initially intended to be colored if the head of hair is being colored in streaks. The quality and accuracy of the streaking effect achieved are therefore adversely affected.

SUMMARY OF THE INVENTION

It is an object of the invention to meet at least one of the needs set out hereinabove by providing a device for applying a hair product which includes a support on one face of which there project application elements. The application elements can be arranged in such a way that a first group of application elements of a first row is superposable, along a longitudinal axis of the support, with a second group of application elements of a second row. The application elements of the second group have a mean flexibility greater than the mean flexibility of the application elements of the first group, and the mean of the spacings between application elements that make up the second group are less than the mean of the spacings between application elements that make up the first group. In addition, the application elements of the second group have a mean height greater than a mean height of the application elements of the first group.

When such a device is used to apply product to a lock of hair, the application elements of the second group, being taller than those of the first group, are the first to engage with the hair in the lock, regardless of which longitudinal edge is the leading edge of the device relative to the lock of hair. Thereafter, the application elements of the first group engage, to brush through the lock of hair. As the product is preferably held in the elements of the first group, the lock of hair engages therewith, and the lock is placed in contact with the product. In a preferred arrangement, by way of example, the application elements of the second group can deform, during a relative movement of the device along the lock of hair, for example translationally along an axis perpendicular to the longitudinal axis of the support, to form a pallet which presses against the hair already engaged in the elements of the first group. Thus, the application of product near the roots of the lock of hair is improved, and in addition, the lumps can be broken up between these elements of the second group and the hair held in the elements of the first group, so the product applied is more uniformly and more effectively. The length and the flexibility of the elements of the second group together allow this active collaboration with the lock of hair with a view toward crushing the lumps.

The device according to the invention makes it possible in particular to break up into small pieces the lumps contained in the mixture that is to be applied to the hair, thus making it possible to make the coloring result more uniform and/or the treatment of the locks of hair more accurate. In addition, this device may improve the uniform impregnation of the product into the head of hair.

The flexibility of an application element is, for example, evaluated by exerting a given force at the free end of the application element, but one which remains within the elastic limit of the application elements. This force is exerted at right angles to a main axis of elongation of the application element, and the angle formed between this free end and a basal portion or base portion of the application element, at a point of attachment of this element relative to the support is measured. For the same exerted force, the larger the angle, the more flexible the application element.

Preferably, by way of example, the force is exerted on an application element in a direction perpendicular to the longitudinal axis of the support, so as to simulate the deformation of this element when the device according to the invention is engaged with a lock of hair, and moved along this lock of hair, and/or so as to simulate the deformation of the application elements when they are brought into contact with the user's scalp, thus making it possible to evaluate how comfortable such a device will be to use.

The application elements of the second group are preferably designed to form an angle greater than the angle formed by the elements of the first group, for the same force exerted. In particular, the application elements of the first group are designed to form an angle smaller, preferably at least by half, than the angle formed by the application elements of the second group. For example, the application elements of the first group can form an angle of the order of 30° when the application elements of the second group form an angle of the order of 90°, with the same force applied respectively to each.

The spacing between two successive application elements of one and the same group is considered at their basal portion or base, in as much as these application elements are not necessarily straight or necessarily embedded in such a way as to run or extend parallel to one another. In particular, the spacing is measured between the respective centers of inertia of two consecutive application elements.

Further, by way of example, the application elements of the second group can advantageously at least partially flank the first group of application elements, with the latter being arranged along at least one longitudinal edge of the first group, and preferably along each of the opposite longitudinal edges of this first group. For example, the surface delimited between the elements of the second group may delimit the surface from which all the elements of the first group protrude. As a preference, all the elements of the second group lie around those of the first group.

As a further example, the device can include a third row of consecutive application elements such as those of the second group, with the application elements of the first group then being arranged between the second and this third row, the second row and the third row respectively longitudinally and at least partially bordering these application elements of the first group, and with these rows being at least partially respectively superposable along the longitudinal axis of the support. When such a device is used to apply a product to a lock of hair, the application elements of the second group, being arranged on each side of those of the first group, can be the first to engage with the hair in the lock, whatever longitudinal edge is the leading edge of the device relative to the lock of hair.

Advantageously, by way of example, at least one application element of the second row is arranged near a peripheral edge of the face of the support. More particularly still, the second row formed with elements of the second group may be parallel to a longitudinal axis of the support. As a further preference, and also by way of example, the second row stands at the periphery of the face of the support, along a longitudinal peripheral edge of this support so as to be located at or near the periphery. Also preferably, if there is one, the third row of application elements of the second group also stands at the periphery of the face of the support, along a second longitudinal peripheral edge of this support so as to be located at or near the periphery.

For example, this third row (if provided) may be parallel to at least one chosen from the first or second row. By way of example, the application elements of the third row can be a constant height.

Advantageously, at least one application element of the second group may have a height greater than the height of the application elements of the first group. For example at least one element of the second group can be at least 4 mm taller than the application elements of the first group. Also by way of example, according to a preferable arrangement, the mean height of the elements of the second group can be at least 4 mm taller than the mean height of the elements of the first group.

The height of an application element is measured along an axis running perpendicular to the longitudinal axis of the support and, if appropriate, running more or less perpendicular to that face of the support from which the application elements protrude.

According to another advantageous feature, by way of example, in order to improve the retention of product between the elements of the first group, while at the same time ensuring effective brushing, the application elements of the first group can have at least two, and preferably three, different heights.

Advantageously, the application elements of the row or, as appropriate, rows, of application elements of the second group are of constant height.

Considering the cross sections of the application elements respectively at their basal portion or base, the application elements of the first group have a cross section greater than that of the application elements of the second group. Moreover, these cross sections are not necessarily homothetic with one another. According to one example of the invention, at least one application element of the second group has a triangular cross section, whereas at least one application element of the first group has an ovoid, and preferably circular, cross section.

In order to improve still further the brushing of the hair in a lock of hair engaged in such a device, the first group preferably includes application elements having at least two different cross sections.

In order to give the application elements of the second group greater flexibility, these elements are preferably more tapered than the application elements of the first group.

Further by way of example, in as much as the application elements of the second group are designed to be the first to engage with the lock of hair, the surface defined by the free ends of the application elements of the first and second groups can have at least one concave or recessed region.

For example, an application element of the second group may have a free end having a flat cross section, while the free end of an application element of the first group can preferably be rounded.

In order to offer a gentle contact between the scalp and the free ends of the application elements, the application elements of the second group are preferably deformable even when a light force oriented along the longitudinal axis of the application element is applied to its free end, whereas if this same light force is applied to the free end of an application element of the first group, this element preferably does not deform. This light force is, for example, of the order of magnitude of a "tolerable" force exerted at an isolated point on the surface of the scalp.

In particular, by way of example, the application elements may be teeth formed as a single piece with the support from which they protrude, or may alternatively be formed of bristles attached to this support. Preferably, and again by way of example, the application elements of the first and/or the second group are produced as a single piece with at least part of the support.

Advantageously, the device according to the invention can be formed by moulding a thermoplastic, particularly a polypropylene or a polyethylene, and more particularly from a low-density polyethylene with a Shore D hardness of between 40 and 80 inclusive, for example.

Preferably according to an example, the application elements stand along or extend from one and the same flat surface of the support. For example, the application elements of the first and of the second group can run parallel to one and the same direction, for example with this direction to be perpendicular to the face of the support.

According to a first embodiment of the invention, the device includes a handle a first end of which is secured to the support bearing the application elements. For example, this handle can have a longitudinal axis parallel to a longitudinal axis of the support. Preferably, the handle is cranked or offset so as to exhibit a portion for holding that extends in a plane different from that of the face of the support. Thus, the way in which the device is held prevents the user from placing her fingers in the same plane as the support, that is to say in the same plane as that of the lock of hair that has just been coated.

According to a preferred example, the handle can include, at a second end which is the opposite end to the first end, a third group of application elements. These application elements may run parallel to the longitudinal axis of the handle, or make an angle relative to that axis. Furthermore, the elements of this third group may be different from one another. Preferably, this second end bears fewer application elements than the support, in as much as they are intended preferably to be used for making the final touches to the application of hair product, in particular around the temples.

According to an example of a second embodiment, the support is mounted on a container containing a hair product and equipped with at least one dispensing orifice to produce fluidic communication between the container and the face of the support. According to a preferred example, the dispensing orifice opens in the middle of the application elements of the first group.

According to this second embodiment, the support is preferably mounted so that it can turn or be moved relative to the container so that it can be fixed or positioned on the container in at least two different positions. Preferably, the container and the support are arranged in such a way that, in a first position, the at least one dispensing orifice does not communicate with the product contained in the container. Thus, the user can homogenize the mixture in the container by shaking it, without the risk of leakage through the aforementioned orifice. Further, the container and the support are arranged in such a way that, in a second position, the at least one dispensing orifice communicates with the product contained in the container, which allows the product to be applied to the hair.

According to another aspect of the invention, a kit or assembly for applying a hair product is provided, which is particularly advantageous for a coloring product. The kit includes a container for packaging the said product, and also a device according to the invention as described herein for applying the product.

As should be apparent, the invention can provide a number of advantageous features and benefits. It is to be understood that, in practicing the invention, an embodiment can be constructed to include one or more features or benefits of embodiments disclosed herein but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will be better understood from reading the description which follows and from examining the accompanying figures. These are provided solely as nonlimiting examples of the invention. In the drawings.

DETAILED DESCRIPTION OF THE PREFERRED EMBODIMENTS

Figure 1:
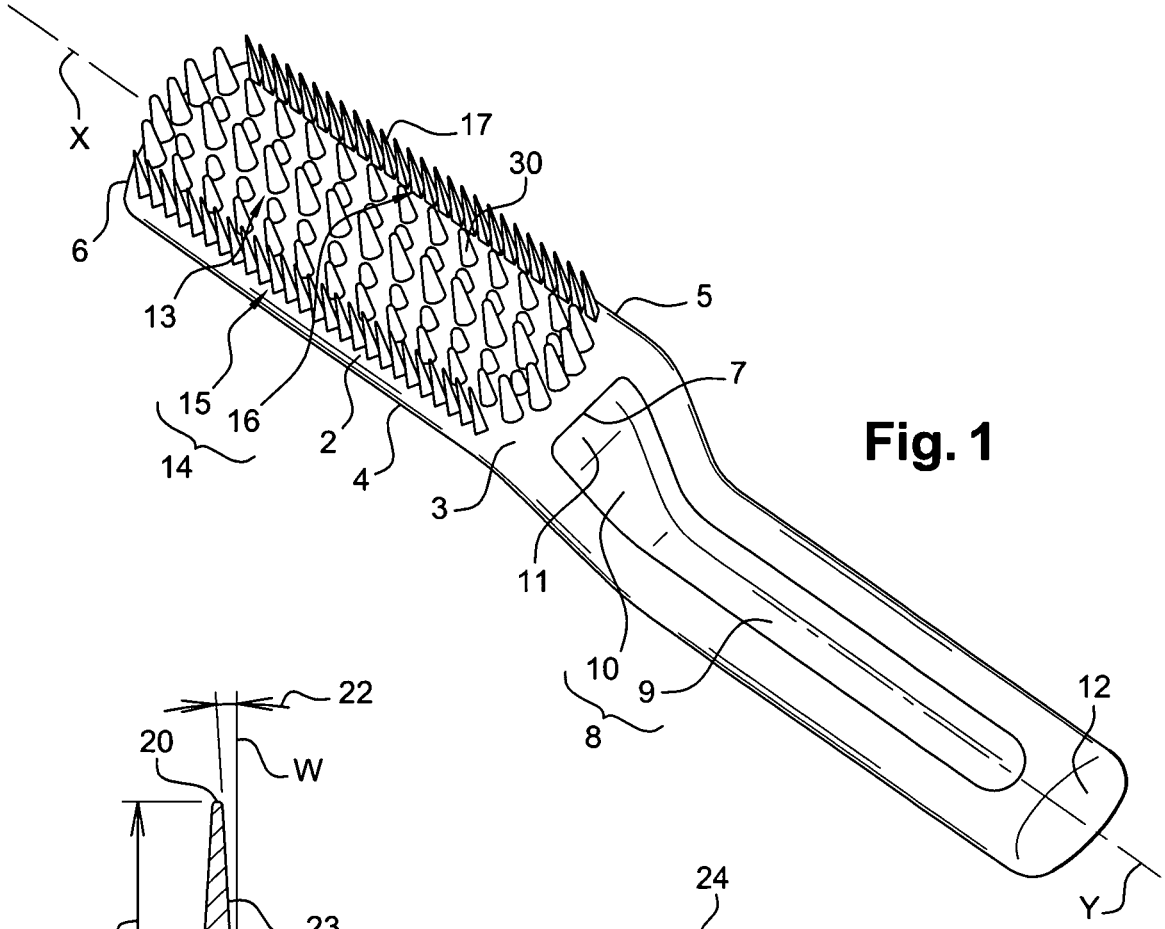
FIG. 1 is a perspective view of a device according to the invention according to a first embodiment.

FIG. 1 depicts a device 1 for applying a hair coloring product to the hair, according to a first exemplary embodiment of the invention. This device includes a support 2 exhibiting a more or less flat face 3 on which application elements stand. The application elements are bristles or teeth which do not diffuse product in this example. Also, in this example, the bristles do not have an opening orifice able to be placed in fluidic communication with a container of product so as to allow the product to flow through these application elements.

In particular, the support 2 runs along a longitudinal axis X in such a way that longitudinal peripheral edges 4 and 5 respectively of the face 3 are more or less parallel to the longitudinal axis X of the support 2. In particular, when viewed from above, the face 3 has a rectangular cross section in this example. At a first axial end, an edge 6 corresponding to one of the shorter sides of this face 3 is, for example, slightly bowed, so as to give this support 2 a rounded end.

At a second axial end, the opposite end to the first axial end, the shorter second edge 7 of the face 3 is connected to a first end 11 of a handle 8. This handle 8 includes at least one portion 9 for holding, running along a longitudinal axis Y oriented preferably parallel to the longitudinal axis X of the support 2. The handle 8 has a second end 12, at the opposite end of the longitudinal axis Y to the first end 11. The portion 9 for holding is connected to the face 3 by an intermediate portion 10 of the handle 8, with this intermediate portion 10 running in a direction secant to the aforementioned longitudinal axes X and Y respectively.

In particular, the portion 9 for holding and the intermediate portion 10 of the handle 8 are equipped with lateral ribs parallel to the longitudinal axis Y so as to stiffen the structure of the handle 8. The device according to this example of the invention is designed so that the longitudinal peripheral edges 4 and 5 are perpendicular to a recommended direction of travel of the support 2 relative to a lock of hair.

A distinction may be drawn with the application elements between two groups of application elements 13 and 14 respectively. A first group 13 of application elements is arranged some distance from the longitudinal peripheral edges 4 and 5 of the face 3, whereas the application elements of the second group 14 are interposed between at least one, and preferably both, of the longitudinal peripheral edges 4 and 5 and the application elements of this first group 13. The elements of the second group 14 are arranged along at least part of a perimeter delimiting all the elements of the first group 13. These elements of the second group 14 are arranged spaced from this perimeter. The application elements of the second group have a mean flexibility greater than the mean flexibility of the application elements of the first group. The mean of the spacings between application elements that make up the second group is less than the mean of the spacings between application elements that make up the first group. The application elements of the second group have a mean height greater than a mean height of the application elements of the first group.

Figure 2:
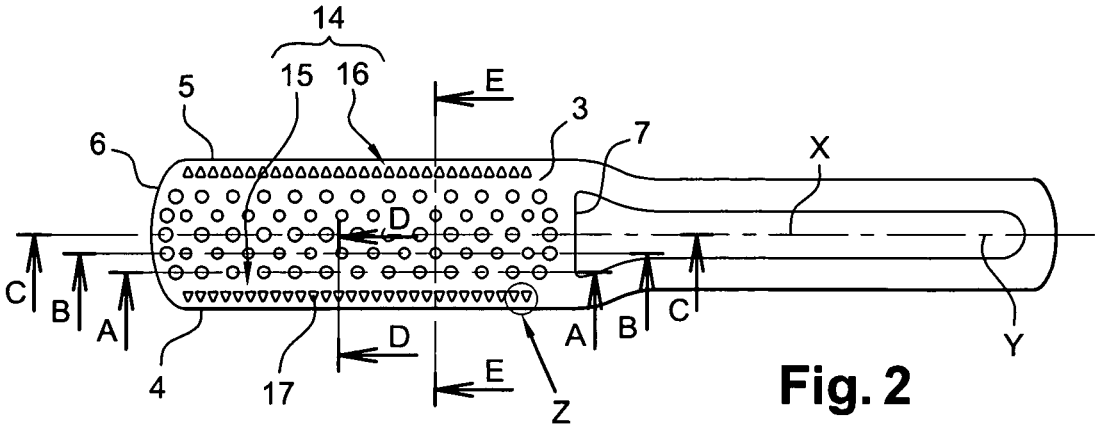
FIG. 2 is a plan view from above of the device of FIG. 1.

In particular, as can be seen in FIGS. 1 and 2, the application elements of the first group 13 are arranged in a first row 25 (FIG. 4), and the application elements of the second group 14 are arranged in such a way that these elements are arranged in one and preferably two rows, a second row 15 and a third row 16, respectively.

The second and third rows 15 and 16 each include at least three, and preferably 28 (for example), consecutive application elements, preferably ones which are mutually identical and/or uniformly spaced apart. These two rows 15 and 16 are preferably parallel to one another and parallel to the longitudinal axis X of the support 2. The rows 15 and 16 therefore run, for example, a few millimeters away from and parallel to the longitudinal peripheral edges 4 and 5 such that the application elements of the first group 13, and preferably all those of the first group 13, are positioned between these two rows 15 and 16.

Figure 3B:
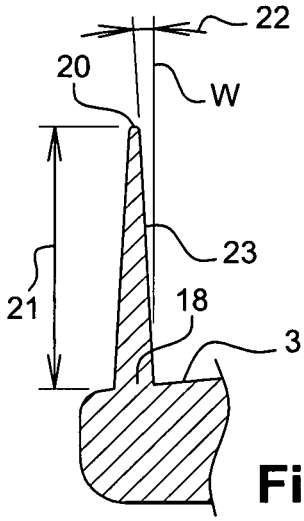
FIG. 3*b* is a view in cross section on the plane of section D-D in FIG. 2.
Figure 3A:
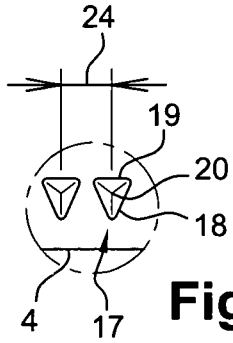
FIG. 3*a* is an enlarged view of region Z of FIG. 2.

By way of example, as depicted in FIG. 2, and more particularly visible in FIGS. 3*a* and 3*b*, an application element 17 of the second group 14 has a truncated pyramid shape with a triangular cross section. Specifically, it includes a basal or base portion 18 of triangular cross section, such as one forming an isosceles triangle, the base 19 of which is about 1.3 mm long and the height of which is about 1.4 mm, for example. The base 19 is, for example, parallel to the longitudinal axis X of the support.

The application element 17 is also tapered. A free end 20 of this application element 17 is flat, preferably also of triangular cross section, but of dimensions appreciably smaller than those of the cross section of the basal or base portion 18. The application element 17 has a height 21 defined between the basal portion 18, at a plane of attachment of this application element 17 to the plane formed by the face 3 of the support 2, and its free end 20, that is of the order of 9.5 mm, for example. Preferably, all the application elements of the second group 14 have a more or less constant height.

In FIG. 3*b*, where the application element 17 stands more or less at right angles to the face 3 of the support 2, this height 21 is measured relative to an axis W perpendicular to the face 3 of the support. Nonetheless, a straight line passing through the respective centers of inertia of the sections at the basal portion and at the free end need not necessarily be parallel to this axis W. This is because an angle 22, formed between a plane 23 connecting the respective bases of the isosceles triangles of the basal portion 18 and the free end 20 respectively, and the axis W perpendicular to the face 3 is appreciably smaller than the angle formed by the other planes of this application element 17 and this same axis W. In particular, it is of the order of 2°, for example.

As depicted in FIG. 2, each application element such as 17 of the second group 14 is arranged in such a way that a direction defined from the base such as 19 of each section, perpendicular to this base 19, points towards the closest longitudinal peripheral edge 4 or 5. In particular, the direction defined from the base 19 of the application element 17 of the region Z preferably points towards the first longitudinal peripheral edge 4 to which this application element 17 is adjacent as shown in FIGS. 2 and 3*a*.

Along the longitudinal axis X, a spacing 24 between the respective centers of the bases such as 19 of two consecutive successive application elements such as 17 of the second group 14 is, for example, of the order of 2 mm.

Figure 4:
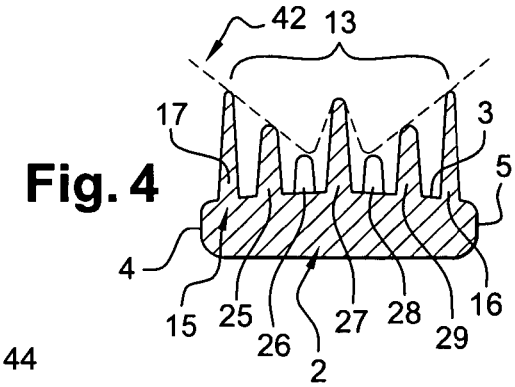
FIG. 4 is a view in cross section on the plane of section E-E in FIG. 2.

As is particularly visible in FIGS. 1, 2 and 4, the application elements of the first group 13 are arranged between the rows 15 and 16 of the second group 14. In particular, they are defined in the portion of the support 2 which is delimited respectively by the rows 15 and 16 and straight-line portions connecting the longitudinal ends of these rows 15 and 16 respectively.

The first row 25 of application elements of the first group 13 runs parallel to the longitudinal axis X of the support 2. It is, for example, adjacent and parallel to the second row 15 of elements of the second group 14. In particular, the first row 25 includes at least three, and preferably eleven in the illustrated example, consecutive application elements, with these elements being mutually identical and/or uniformly spaced apart in the example shown.

Figure 5:
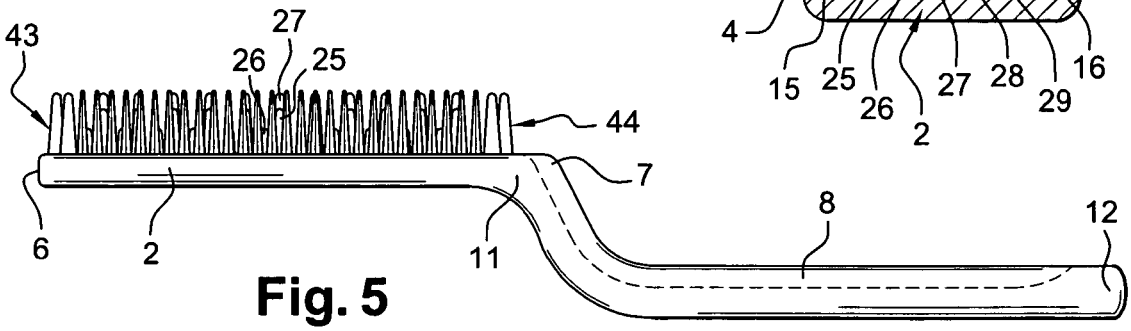
FIG. 5 is a side view of the device of FIG. 1 in a direction perpendicular to a longitudinal axis of this device.

In addition, the first group 13 includes a fourth and a fifth row 26 and 27 respectively, with the fourth row 26 being arranged between the first row 25 and the fifth row 27. The first, the fourth and the fifth row are preferably oriented parallel to the longitudinal axis X, the application elements of one row being, for example, offset along this longitudinal axis X relative to the application elements of the adjacent row. In particular, as can be seen in FIG. 5, the elements of the first 25 and of the fifth 27 row are arranged facing each other whereas the elements of the fourth row 26 are offset relative to these elements. They form chicanes which improve the coating of the lock of hair held between these elements.

Preferably, the support 2 has a plane of symmetry passing through its longitudinal axis X and running perpendicular to its face 3, so that this plane of symmetry also passes through the application elements of the fifth row 27, and such that the first group 13 includes a sixth row 28 symmetric with the fourth row 26, a seventh row 29 symmetric with the first row 25, and the third row 16 of elements of the second group 14 itself being the mirror image of the second row 15 of the elements of this same second group 14 about this same plane of symmetry.

In the illustrated arrangement, by way of example, an application element 30 of the first group 13 is of frustoconical shape such that its basal or base portion 31 has a circular cross section, for example having a diameter of between 1.7 mm and 2.2 mm depending on the row to which it belongs, such that its free end 33 is rounded. Preferably, this application element 30, preferably like all the other elements in the first group 13, stands perpendicular to the face 3 such that its height measured along an axis parallel to the axis W is shorter than the height 21 measured along the same axis of the application elements such as 17 of the second group 14. For example, this application element 30 has a height of between 3.8 mm and 9 mm according to the row to which it belongs. An angle 35 formed between a straight line 36 of the frustoconical external periphery and this axis W is, for example, of the order of 3°.

In addition, along the longitudinal axis X, a spacing 37 between the respective centers of the basal portions such as 31 of two successive application elements such as 30 of the first group 13 belonging to one and the same row is greater than the spacing 24, while at the same time preferably not being an integer multiple of this spacing 24. For example, it is of the order of 4.92 mm. According to the preferred example, the application elements of the first, of the fourth and of the fifth row are spaced uniformly apart, all by this same spacing 37.

Figure 6A:
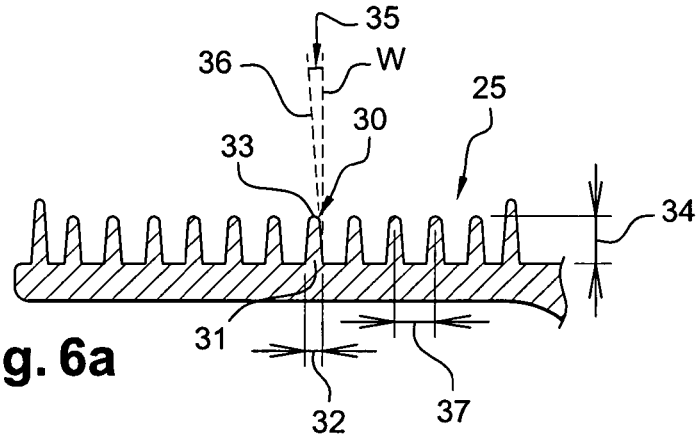
FIGS. 6*a*, 6*b* and 6*c* are views in longitudinal section on the planes of sections marked A-A, B-B and C-C in FIG. 2, respectively.
Figure 6B:
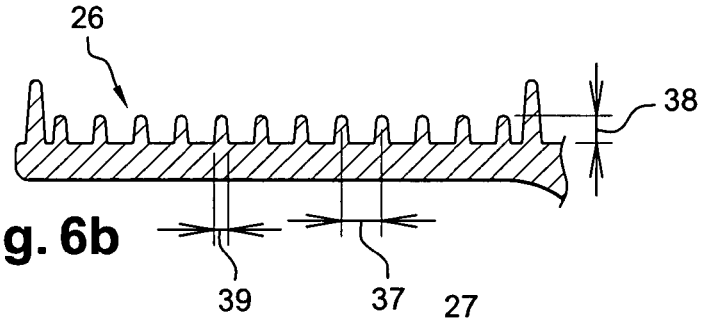
Figure 6C:
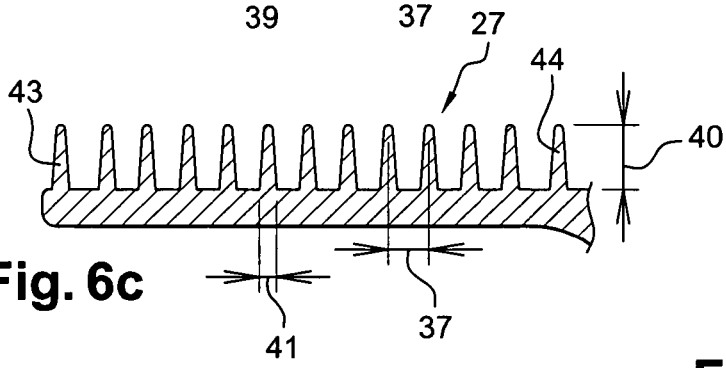

The application elements of the first, fourth and fifth row have heights and, respectively, diameters at their basal or base portion which respectively differ. In particular, by way of example with an arrangement as in FIG. 6*a*, the application elements of the first row 25 can have a mean height 34 of the order of 6.4 mm and a mean diameter 32 of the order of 1.8 mm. In FIG. 6*b*, the application elements of the fourth row 26 can have a mean height 38 of the order of 3.8 mm and a mean diameter 39 of the order of 1.7 mm by way of example. In FIG. 6*c*, the application elements of the fifth row 27 have a mean height 40 of the order of 9 mm and a mean diameter 41 of the order of 2.2 mm.

The application elements such as 17 of the second group 14 are structurally more flexible than the application elements such as 30 of the first group 13 even when they are made of the same material. By way of example, the support 2 and the application elements it bears can be moulded as a single piece in low-density polyethylene so as to limit the cost of manufacture of a device according to the invention.

As can be seen in FIG. 4, the surface 42 passing through the free ends 33 and 20 respectively of the application elements of the first and second groups 13 and 14 have two concave regions or depressions on either side of the plane of symmetry passing through the fifth row 27. In particular, in cross section, this surface exhibits a cross section in the shape of a W, the concave regions or depressions running longitudinally along the axis X of the support.

Finally, the device 1 preferably includes two rows 43 and 44 of elements such as those of the fifth row 27 arranged in arcs facing the short sides 6 and 7 of the support respectively. These rows 43 and 44 connect the rows 15 and 16 of elements of the second group 14 at their respective ends. They thus delimit, with the rows 15 and 16, the region on the face 3 of the support 2 where the application elements of the first group 13 in the main stand, and where product can be held, when such a brush is dipped into a bowl of product so that this product can be applied to a selected lock of hair.

Figure 11:
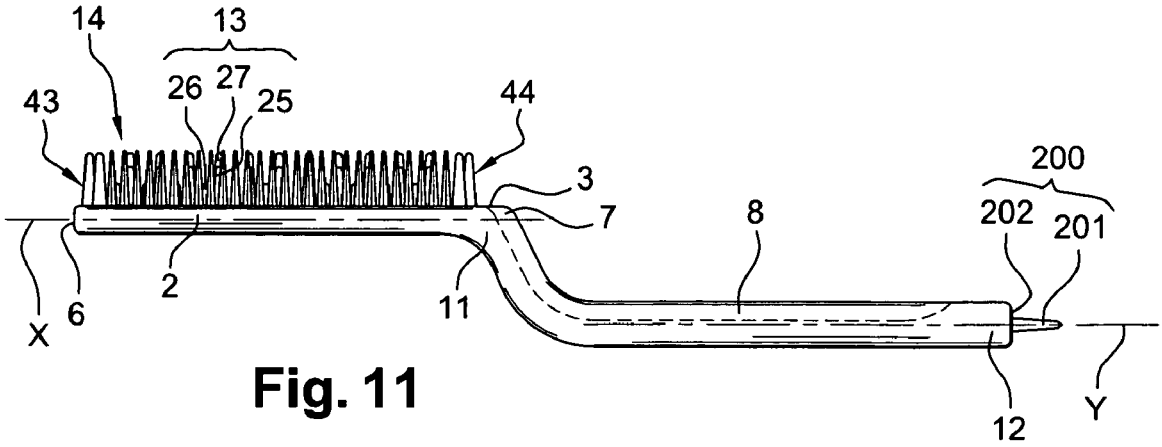
FIGS. 11 to 13 are side views of alternative forms of an embodiment of a device according to the invention equipped with a third group of application elements, viewed in a direction perpendicular to a longitudinal axis of the device.
Figure 12:
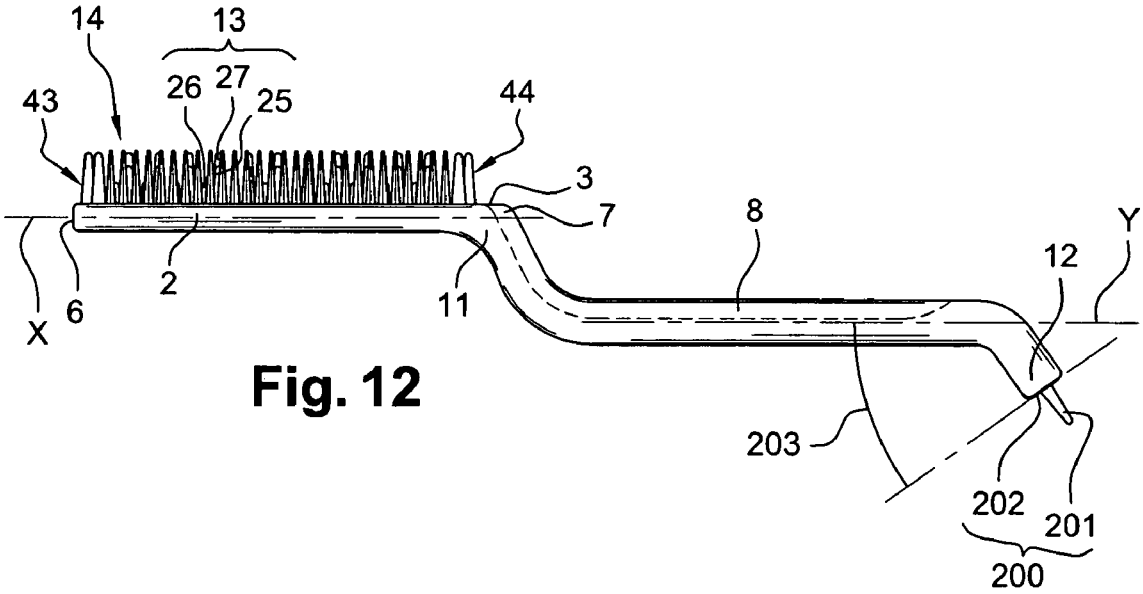
Figure 13:
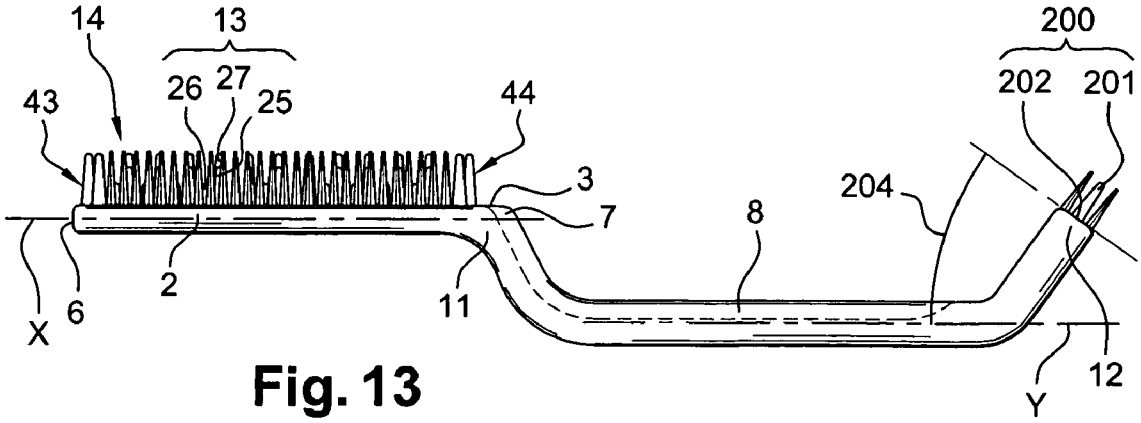

According to alternative forms or examples of embodiment shown in FIGS. 11 to 13, at the second end 12 the handle 8 includes a third group 200 of application elements. For example, this third group 200 includes teeth and/or bristles preferably intended for use on very short hairs, for example around the temples, or for touching up an overall treatment. In particular, application elements such as 201 of this third group 200 may be oriented along the longitudinal axis Y as depicted in FIG. 11 or in such a way as to form an angle with this axis Y as depicted in the alternative forms in FIGS. 12 and 13.

For example, according to FIG. 12, the application elements 201 of the third group 200 can run in a direction more or less the opposite of that of the elements of the first 13 and second 14 groups. For example, they stand more or less at right angles to a surface 202 of the second end 12 of the handle 8, with this surface 202 making an acute angle 203 with the axis Y, this angle being, for example, of the order of 45°. By contrast, according to the alternative form depicted in FIG. 13, the application elements 201 of the third group 200 can be oriented in a different direction but one which is nonetheless more or less on the same side as the application elements of the first 13 and second 14 groups. In FIG. 13, the surface 202 also makes an acute angle 204 with the axis Y, but this acute angle 204 is formed on the opposite side of the handle 8 to that side of the handle with which the surface 202 forms the acute angle 203 in the context of the embodiment of FIG. 12.

In particular, the third group 200 includes application elements 201 which may be arranged in one or more rows. The application elements 201 may all be identical to one another or, by contrast, these application elements may be tapered differently from one another or have different heights, flexibilities or mutual spacings. In particular, this third group may be formed of application elements configured like those of the first 13 and second 14 group.

Figure 7:
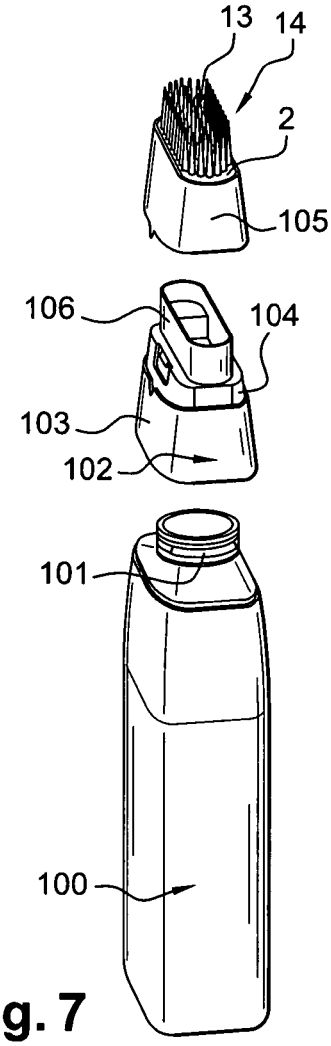
FIG. 7 is an exploded view of a device according to a second embodiment of a device according to the invention.

According to a second embodiment, features of the invention are utilized in the context of an arrangement as taught in document FR-A-2 828 999, in which the support 2 according to the invention is not equipped with a handle such as 8 but, as can be seen in FIG. 7, includes a container 100 onto which the support 2 can be removably fixed. The container 100 is made up of a compressible body equipped with a neck 101 at the top, such that an adapter part 102, including in the example described an added component, which can be fixed onto this neck 101 and which is itself intended to accept the support 2.

The container 100 may contain one or more products, for example with the container 100 configured to allow these products to be mixed. It may also take on the form of a pressurized container.

Figure 8:
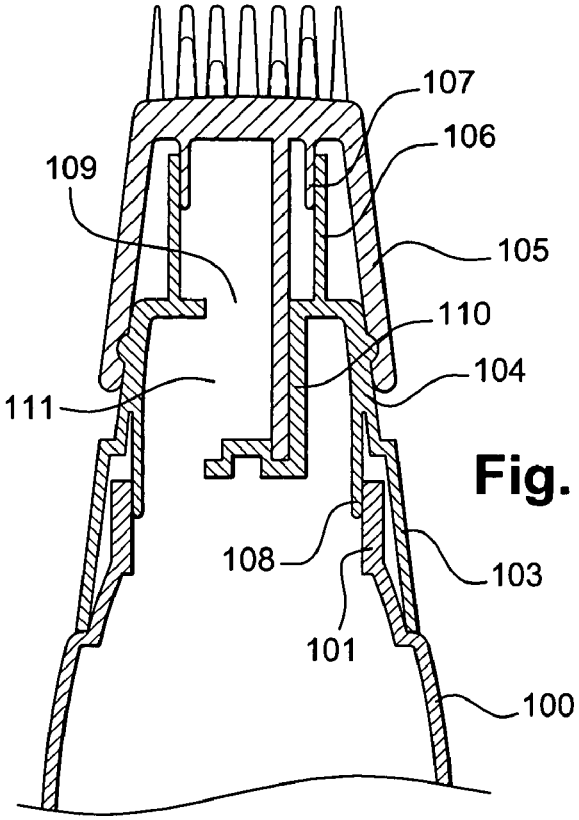
FIG. 8 is a partial view in longitudinal section of the assembled device of FIG. 7 in the open position.

In the example of FIG. 8, the adapter component 102 includes a covering skirt 103 intended to lie in or extend as the continuation of the wall of the container 100, and a skirt 104 for accepting an assembly skirt 105 protruding from the support 2. The assembly skirt 105 protrudes from a second side of the support 2, the opposite side to the side exhibiting the face 3 on which the application elements of the first and second group 13 and 14 respectively stand.

The accepting skirt 104 is surmounted by a sealing skirt 106 intended to collaborate in a sealed manner with a sealing skirt 107 provided facing it and protruding from the support 2. It can also be seen that the adapter component 102 includes a sealing lip 108 which presses in a sealed manner against the interior surface of the neck 101. This sealing lip 108 connects to the interior surface of the acceptance skirt 104.

The support 2 is, for example, held by clip-fastening onto the acceptance skirt 104, the adapter component 102 being intended to clip onto the exterior perimeter of the neck 101.

Figure 9:
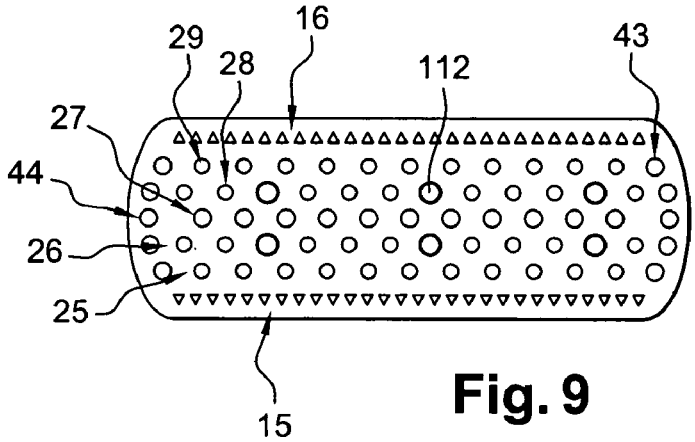
FIG. 9 is a view from above of a support mounted on the device of FIG. 7.
Figure 10:
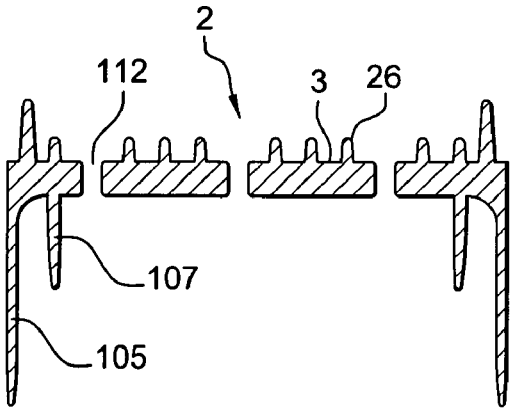
FIG. 10 is a view in longitudinal section of the support of FIG. 9, with the section being taken along a first row of application elements of a first group of this support.

The sealing skirt 106 defines a housing 109 the end wall of which is extended at the bottom by a duct 110 closed at its bottom end and opening via a lateral opening 111 providing fluidic communication between this housing 109 and the container 100. For this purpose, the support 2 includes at least one orifice 112 and, by way of example, according to the embodiment depicted in FIGS. 9 and 10, it includes six orifices such as 112 arranged uniformly so that they open with a uniform spacing onto the face 3.

The openings of these orifices 112 can take the place of the locations of some of the application elements, particularly of some of the application elements of the fourth and of the sixth row, with the diameter and/or the number of orifices being chosen according to the viscosity of the product that is to be applied, for example. Where the orifices 112 are defined, there is no application element, the orifices not extending through these application elements in this example An obturator 113 which is connected to the support 2 on the opposite side to the face 3, takes the form of a portion that is a cylinder of revolution, open over an angular sector smaller than a semicircle. Depending on how the end piece 2 is fitted onto the adapter part 102, in the dispensing position or in the stopping position, the orifices such as 112 may or may not be placed in communication with the housing 109 and therefore with the contents of the container 10. Specifically, the obturator 113 is designed to stop off the lateral opening 111 in the closed position and leave it uncovered in the dispensing position, as depicted in FIG. 8.

To treat the head of hair, the user may move the support 2 through the hair in a direction perpendicular to its longitudinal axis X.

Of course, the invention is not restricted to the examples which have just been described or to the dimensions which are given by way of nonlimiting examples Throughout the description, expressions such as "comprising a", "comprising one", "having" or "has" are to be considered as being synonymous with "comprising at least a" or "comprising at least one" unless specified otherwise.

In the foregoing detailed description, reference is made to preferred embodiments of the invention. It is evident that variants thereto can be proposed without departing from the invention as claimed here below. It is therefore to be understood that, within the scope of the appended claims, the invention may be practiced otherwise than as specifically described herein.

What is claimed as new and desired to be secured by Letters Patent of the United States is:

1. A device for applying a hair product comprising:

a support having a face;

a plurality of application elements which project from said face, said plurality of application elements including a first group of application elements and a second group of application elements, wherein the first group includes at least a first row and the second group includes at least a second row and a third row, and wherein the plurality of application elements are arranged such that the first row, second row, and third row are at least partially superposable, along a longitudinal axis of the support, and wherein the application elements of the second group are each in the form of a single piece tooth extending from the support;

wherein the application elements of the first group are arranged between the second row and the third row, and wherein the second row and the third row each at least partially border the application elements of the first group along a longitudinal direction of the support face;

wherein the application elements of the second group have a mean flexibility greater than the mean flexibility of the application elements of the first group;

wherein the mean of the spacings between application elements that make up the second group is less than the mean of the spacings between application elements that make up the first group; and wherein the application elements of the second group have a mean height greater than a mean height of the application elements of the first group.

2. A device according to claim 1, wherein the face of the support is substantially flat, and wherein at least one application element of the second row is arranged near a peripheral edge of the face of the support.

3. A device according to claim 1, wherein the second row is parallel to the longitudinal axis of the support.

4. A device according to claim 1, wherein the second row is positioned at a periphery of the face of the support, along a longitudinal edge of the support.

5. A device according to claim 1, wherein the third row is parallel to at least one of the rows chosen from the first or second rows.

6. A device according to claim 1, wherein the application elements of the third row have a constant height.

7. A device according to claim 1, wherein at least one application element of the second group has a height greater than the height of the application elements of the first group.

8. A device according to claim 7, wherein the at least one application element is at least 4 mm taller than the application elements of the first group.

9. A device according to claim 1, wherein the first group comprises application elements of at least two different heights.

10. A device according to claim 1, wherein the first group comprises application elements of at least three different heights.

11. A device according to claim 1, wherein the application elements of the first or the second row have a constant height.

12. A device according to claim 1, wherein the application elements of the first group have a cross section greater than that of the application elements of the second group, at respective bases of these application elements.

13. A device according to claim 1, wherein at least one application element of the second group has a triangular cross section.

14. A device according to claim 1, wherein at least one application element of the first group has an ovoid cross-section.

15. A device according to claim 1, wherein at least one application element of the first group has a circular cross-section.

16. A device according to claim 1, wherein the first group comprises application elements having at least two different cross-sections.

17. A device according to claim 1, wherein at least one application element of the second group is more steeply tapered than the application elements of the first group.

18. A device according to claim 1, wherein a surface defined by free ends of the application elements of the first and second groups has at least one concave region.

19. A device according to claim 1, wherein a free end of an application element of the second group is flat.

20. A device according to claim 1, wherein a free end of an application element of the first group is rounded.

21. A device according to claim 1, wherein the application elements of the first group are teeth or bristles.

22. A device according claim 1, wherein the application elements of the first group are teeth each formed as a single piece with at least part of the support.

23. A device according to claim 1, wherein the device is formed as a molded thermoplastic and wherein at least the teeth of the second group are each molded with the support and each tooth is a one piece molded tooth extending from and molded with the support.

24. A device according to claim 23, wherein the thermoplastic is a polypropylene or polyethylene.

25. A device according to claim 23, wherein the thermoplastic is a low-density polyethylene with a Shore D hardness of between 40 and 80 inclusive.

26. A device according to claim 1, wherein the face of the support is flat.

27. A device according to claim 1, wherein the application elements of the first and of the second group protrude parallel to each other and in a direction perpendicular to the face of the support.

28. A device according to claim 1, further comprising a handle, said handle including a first end which is secured to said support.

29. A device according to claim 28, wherein the handle has a longitudinal axis parallel to the longitudinal axis of the support.

30. A device according to claim 28, wherein the handle is offset so as to include a portion for holding that extends in a plane different from that of the face of the support.

31. A device according to claim 28, wherein the handle comprises a third group of application elements at a second end which is opposite to the first end.

32. A device according to claim 1, further including a container which contains a hair product, wherein the support is mounted on the container and equipped with at least one dispensing orifice to produce fluidic communication between said container and the face of the support, wherein the dispensing orifice opens at a location between application elements of the first group.

33. A device according to claim 32, wherein the support is mounted so that it can be moved relative to the container between at least a first position and a second position different from the first, and wherein the container and the support are arranged such that, in the first position, said at least one dispensing orifice does not communicate with the product contained in the container and such that, in the second position, said at least one dispensing orifice communicates with the product contained in the container.

34. A device according to claim 33, wherein said support is rotatable relative to said container between said first and said second positions.

35. A device according to claim 1, further including a container containing a hair product.

36. A device according to claim 1, wherein the second row and the third row are closer to a periphery of said face than elements of said first group, such that elements of said second group which are taller, more closely spaced and have a greater mean flexibility are positioned closer to the periphery of said face, and elements of said first group which are shorter, less closely spaced and have a lower mean flexibility are positioned farther from the periphery.

37. A device according to claim 36, wherein said periphery includes at least first and second longitudinal sides, and wherein said second and third rows respectively extend along said first and second longitudinal sides, and further wherein said first row extends between said second and third rows.

38. A device according to claim 37, wherein at least some of the application elements of said second group have a tapered cross-section which becomes narrower in a direction toward a portion of the periphery of said face which is closest to the tapered cross-section.

39. A device according to claim 1, wherein for a same force applied to application elements of the first and second groups, application elements of the first group deflect to an angle that is smaller at least by half of an angle of deflection of the application elements of the second group.

40. A device for applying a hair product comprising:

a support having a face, said face including a periphery;

a plurality of application elements which project from said face of said support, said plurality of application elements including a first group and a second group, wherein said application elements of said second group extend along at least a portion of the periphery of the face, and wherein application elements of the first group are spaced from said periphery and are disposed between application elements of the second group, and wherein the application elements of the second group are each in the form of a single piece tooth extending from the support;

wherein the application elements of the second group have a mean flexibility greater than the mean flexibility of the application elements of the first group;

wherein the mean of the spacings between application elements that make up the second group is less than the mean of the spacings between application elements that make up the first group;

wherein the application elements of the second group have a mean height greater than a mean height of the application elements of the first group; and wherein elements of said first group are spaced farther from the periphery of the face than elements of the second group such that elements of said second group which are taller, more closely spaced and have a greater mean flexibility are positioned closer to the periphery of said face, and elements of said first group which are shorter, less closely spaced and have a lower mean flexibility are positioned farther from the periphery.

41. A device as recited in claim 40, wherein said periphery of said face includes first and second longitudinal sides, and wherein application elements of said second group extend along said first and second longitudinal sides, and wherein application elements of said first group are positioned between said first and second longitudinal sides.

42. A device according to claim 41, wherein said face is substantially flat between said first and second longitudinal sides, and wherein at least the application elements of the second group are each molded with the support such that each application element of the second group is a one-piece molded tooth extending from the support.

43. A device according to claim 40, wherein said first group includes a first row of application elements, and wherein said second group includes a second row of application elements and a third row of application elements, and wherein said first row is positioned between said second row and said third row.

44. A device according to claim 43, further including fourth, fifth, sixth and seventh rows of application elements between said first row and said third row, wherein at least some of the application elements of said fifth row are taller than at least some of the application elements of said first row and shorter than at least some of the application elements of said second and third rows.

45. A device according to claim 44, wherein application elements of said fourth and sixth rows are shorter than that of said first and seventh rows, and wherein the heights of said first and seventh rows are substantially the same.

46. A device according to claim 40, wherein at least some of the application elements of said second group have a tapered cross-section which becomes narrower in a direction toward a portion of said periphery which is closest to the tapered cross-section.

47. A device according to claim 40, wherein at least some of the application elements of said second group have a triangular cross-section with an apex pointing toward said periphery.

48. A device according to claim 40, further including a container containing a hair product, and wherein said container can be selectively placed in fluid communication with said face of said support.

49. A device according to claim 40, further including a handle having a first end coupled to said support and an opposite second end.

50. A device according to claim 49, wherein a third group of application elements is provided on said second end of said handle.

51. A device according to claim 40, wherein for a same force applied to application elements of the first and second groups, application elements of the first group deflect to an angle that is smaller at least by half of an angle of deflection of the application elements of the second group.

* * * * *